US011828151B2

(12) United States Patent
Holder

(10) Patent No.: US 11,828,151 B2
(45) Date of Patent: Nov. 28, 2023

(54) DEVICE AND METHOD TO STIMULATE A GEOLOGIC FORMATION WITH ELECTRICALLY CONTROLLABLE LIQUID PROPELLANT-WATERLESS FRACTURING

(71) Applicant: Barry Kent Holder, Montgomery, TX (US)

(72) Inventor: Barry Kent Holder, Montgomery, TX (US)

( * ) Notice: Subject to any disclaimer, the term of this patent is extended or adjusted under 35 U.S.C. 154(b) by 135 days.

(21) Appl. No.: 17/356,303

(22) Filed: Jun. 23, 2021

(65) Prior Publication Data

US 2022/0003097 A1 Jan. 6, 2022

Related U.S. Application Data

(60) Provisional application No. 63/047,333, filed on Jul. 2, 2020.

(51) Int. Cl.

| | |
|---|---|
| ***E21B 43/263*** | (2006.01) |
| ***E21B 41/00*** | (2006.01) |
| ***E21B 43/267*** | (2006.01) |

(52) U.S. Cl.

CPC ..... *E21B 43/263* (2013.01); *E21B 41/0078* (2013.01); *E21B 43/267* (2013.01)

(58) Field of Classification Search

CPC .. E21B 41/0078; E21B 43/263; E21B 43/267; E21B 43/2605; E21B 7/18

See application file for complete search history.

(56) References Cited

U.S. PATENT DOCUMENTS

| | | | | |
|---|---|---|---|---|
| 3,257,800 | A | 6/1966 | Lawrence | |
| 3,933,205 | A | 1/1976 | Kiel | |
| 4,798,244 | A * | 1/1989 | Trost | F42B 3/04 102/317 |
| 5,797,260 | A | 8/1998 | Koppel | |
| 6,494,261 | B1 * | 12/2002 | Pahmiyer | E21B 43/04 166/281 |
| 7,228,907 | B2 | 6/2007 | Schmidt | |
| 7,757,476 | B2 | 7/2010 | Coste | |
| 8,317,953 | B2 | 11/2012 | Sawka | |

(Continued)

FOREIGN PATENT DOCUMENTS

WO 2018136093 7/2018

*Primary Examiner* — Yong-Suk (Philip) Ro

(74) *Attorney, Agent, or Firm* — Compton & Associates PLLC; Matthew Compton

(57) ABSTRACT

This application describes a device for stimulating a geologic formation using an electrically throttled liquid propellant. The device may be used for primary stimulation, changing the direction of a fracture in a wellbore during hydraulic fracturing, a re-frac of an existing interval to open new areas in an open interval, or reset fracture conductivity after extended shut in of the well. This comprises deploying the device on tubing or wireline and positioning it close to the selected wellbore interval where liquid propellant can be selectively ignited. The device's controls release and ignite an energetic material that produces expanding gas to increase pressure and stimulate the selected interval. The device is comprised of a reservoir to hold energetic material, a metering system to release propellant at a desired rate, an electrical ignition source to control output, a no backflow valve, and control module that operates the metering and electrical ignition.

11 Claims, 5 Drawing Sheets

(56) References Cited

U.S. PATENT DOCUMENTS

| | | | | |
|---|---|---|---|---|
| 8,464,640 | B2 | 6/2013 | Sawka | |
| 8,617,327 | B1 | 12/2013 | Katzakian | |
| 8,857,338 | B2 | 10/2014 | Sawka | |
| 8,888,935 | B2 * | 11/2014 | Grix | C06B 31/00 149/19.1 |
| 9,382,168 | B2 | 7/2016 | McPherson | |
| 9,534,880 | B2 | 1/2017 | McPherson | |
| 10,385,680 | B2 | 8/2019 | Livescu | |
| 10,487,638 | B2 | 11/2019 | Ciezobka | |
| 10,738,581 | B2 | 8/2020 | Nguyen | |
| 11,428,087 | B2 * | 8/2022 | Nguyen | C04B 26/04 |
| 2004/0089450 | A1 * | 5/2004 | Slade | E21B 41/0078 166/55.7 |
| 2006/0011276 | A1 | 1/2006 | Grix | |
| 2010/0258292 | A1 * | 10/2010 | Tiernan | E21B 43/117 166/63 |
| 2015/0075783 | A1 | 3/2015 | Angman | |
| 2015/0233218 | A1 * | 8/2015 | Myhre | E21B 43/114 166/281 |
| 2019/0153845 | A1 * | 5/2019 | Hunter | E21B 43/248 |
| 2020/0199957 | A1 * | 6/2020 | Bertoja | E21B 23/00 |

* cited by examiner

DEVICE AND METHOD TO STIMULATE A GEOLOGIC FORMATION WITH ELECTRICALLY CONTROLLABLE LIQUID PROPELLANT-WATERLESS FRACTURING

CROSS REFERENCE TO RELATED APPLICATIONS

This application claims priority to U.S. provisional patent application No. 63/047,333 filed on Jul. 2, 2020, the disclosure of which is incorporated herein by the reference.

FIELD OF THE INVENTION

The present invention generally relates to the stimulation of a geologic formation through the burning of liquid propellant.

BACKGROUND OF INVENTION

The application generally relates to gas production from the burning of propellants that produce enough gas pressure to penetrate near wellbore skin damage and provide stimulation by opening a path from the inner diameter (ID) of the production casing to the geologic formation. The ability to selectively change the rate of injection into an interval in a wellbore during hydraulic fracturing can change the direction of the fracture. This method was made popular by Othar Meade Keil in the 1970's. As horizontal well spacing becomes closer the need for more fractures between the wellbores is more important than fracture length. Too much frac length can intersect a nearby wellbore causing interference that connects the two wellbores. This has a negative impact on production. The device can also be used to provide near wellbore stimulation on an open interval in a manner similar to the technique developed from research published by the Gas Research Institute on paper GRI-80/0144 and Sand82-0866 for contract 5080-321-0434 in 1982. Unlike the solid based propellant products that burn to completion, liquid propellant volume is not finite when used with tubing and may be turned on or off and throttled up or down selectively. This enables the use of this device for waterless fracturing. The electrically controlled propellant referenced in U.S. Pat. No. 8,888,935B2 assigned to Digital Solid-State Propulsion may be used for this device.

SUMMARY OF SELECTED EMBODIMENTS

One embodiment is a device deployed with coiled tubing containing electric coaxial cable inside the coiled tubing into a production casing and a device placed in the area of a flow control sleeve that is opened to stimulate a desired interval. The interval is hydraulically fractured down the production casing. The device is selectively activated, and the energetic material provides high pressure gas that increases the flow rate into the interval for a selected duration. The propellant flow rate may be constant, pulsed, or varied to produce desired results. This will increase the flow rate into the interval quickly without friction or time delay associated with pumping fluids down the entire length of the production casing. This embodiment and method will change the direction of a fracture potentially increasing fracture density. The device may be activated more than once per fracture treatment.

This device may also be used with in conjunction with a special casing attachment called a propellant tool that becomes part of the production casing. The propellant tool has energetic material in a compartment outside the casing and a method to open a path from the production casing to the interval. The liquid propellant stimulation tool can trigger the propellant tool cemented in the well as part of the production casing to break down the interval and establish flow between the ID of the production casing and the interval. The liquid propellant stimulation tool is activated and burning liquid propellant provides high rate gas flow to fracture the interval. This embodiment may be used with hydraulic casing fracturing or the device only as a method for waterless fracturing.

Another embodiment will use the same device with the addition of a packer or packers to provide zonal isolation above or below the device inside the production casing as required. This device can provide primary or secondary stimulation depending on the application. The device may use a marker located as an integral part of the production casing to locate a position in the production casing and provide stimulation through a sleeve or perforations. This embodiment and method is for primary stimulation, re-frac or a remedy for production problems.

The device uses an electric trigger to ignite the liquid propellant. The design of the trigger can be used to regulate the rate of ignition and control the amount of gas generated. There are various designs for the trigger depending on the application and desired results. In this example the trigger ignites liquid propellant while it is inside the tubing. It may be desirable to ignite the liquid propellant on the outside of the tubing. Or have multiple electronic triggers. The electric trigger may be part of a sleeve or propellant tool cemented in a well and associated with the interval or designed to trigger from the liquid stimulation tool to the perforated production casing. A reaction that occurs inside the interval and outside the production casing can reduce the temperature inside the casing. This would allow longer stimulation periods.

The coaxial cable is common to cased hole and open hole wireline operations in the oil and gas industry. The device may use a simple mono conductor cable such as Camesa 1N32 5/16" cable or multiconductor such as the 7 conductor 7Q38 3/8" cable from Camesa. The selection is not limited to Camesa as Forum Energy technologies and other suppliers can supply this cable in a variety of sizes and configurations. It may also contain fiberoptic cable for sensing and communication.

The control module is linked to peripherals that provide information sent to surface through the coaxial cable. A common peripheral is a pressure and temperature transducer that provides information on conditions inside the coiled tubing and outside the coiled tubing. It would be common to have more than one of these. Another is a reader that can find a specified position in the production casing. It may be a device designed to find a unique marker placed in the production casing, a common collar locator, gamma ray tool, or a material loss detection sensor to identify perforations in the production casing. The device can be controlled from surface and/or software in the electronics located in the control module based on input from the peripherals and supervision from the surface.

The control module will contain electronics with a processor and programmed code referred to as firmware. This code will process information from the onboard peripherals and provide information to control other peripherals such as the meter valve and electric trigger. It may also receive information from outside peripherals that identify tracers or measure micro seismic data and make decisions based on the data with or without assistance from surface. The control module and stimulation device may be a key part of automated hydraulic fracturing or machine based AI fracturing.

This device may also be deployed on jointed tubing or slickline with a battery powered control module. It may also be deployed on cased hole or open hole wireline with the standard configuration using conventional cased hole and open hole wireline units.

The device can provide primary stimulation, secondary or remedial stimulation, as well as treatment for problems related to production such as asphaltenes, paraffin, various scales, and formation blockage such as swelling clays.

BRIEF DESCRIPTION OF THE DRAWINGS

FIG. 2A depicts a base stimulation tool embodiment; FIG. 2B depicts a stimulation tool embodiment for use in a waterless fracturing application; and FIG. 2C depicts a stimulation tool embodiment for use in re-fracturing.

DETAILED DESCRIPTION OF SELECTED EMBODIMENTS

Figure 1:
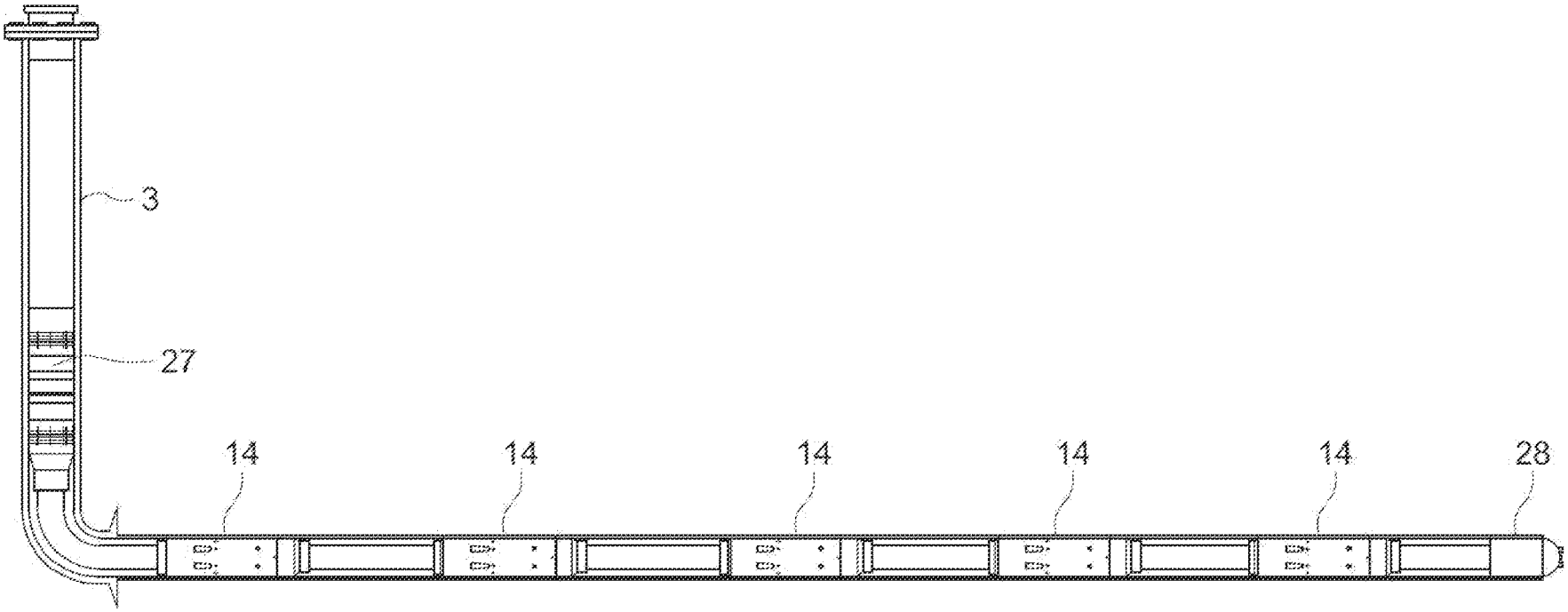
FIG. 1 depicts a common horizontal well with locating marker with profile positioned across desired production intervals

FIG. 1 shows an illustration of a horizontal wellbore with a plurality of locating markers with profile (14). These markers may be sliding sleeves with open and closed position, propellant tool as described in patent U.S. Pat. No. 9,896,920, or cluster of shaped charge perforations that are part of the production casing (3). The stimulation assembly (2A,2B,2C) is capable of identifying the locating markers with profile (14) and anchoring the device in the proper position. A production packer (27) anchors the production casing (3) and is placed just above the horizontal section of the production casing (3) to isolate the productive pay zone from the intermediate casing. A float shoe (28) is run on the end of the casing to prevent backflow of cement after cementing the production casing (3) in place. The Illustration shows five locating markers with profile (14). It is common practice to have 50 or more of these in a single wellbore. The length between the intervals may vary based on completion preferences.

Figure 2A:
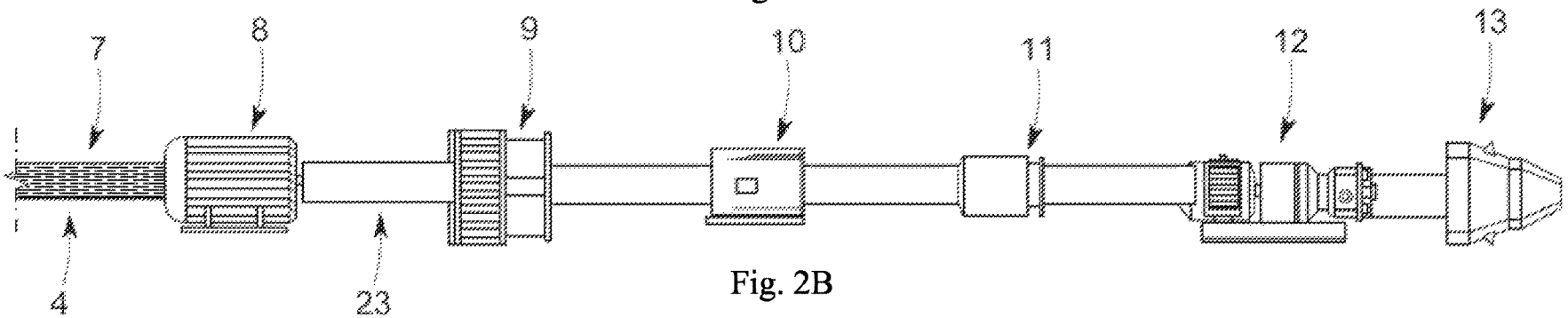
FIGS. 2A-C show three common device configurations.
Figure 2B:
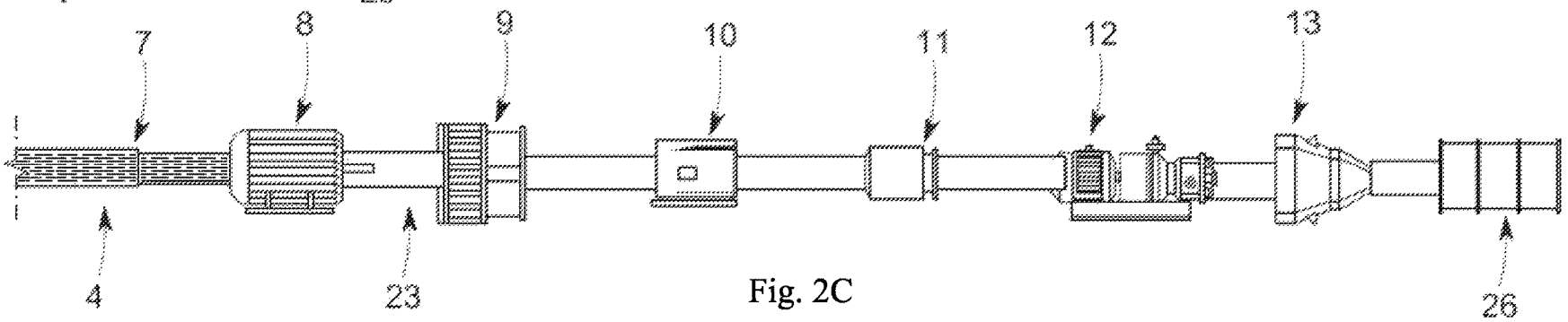

FIG. 2A is a base stimulation tool. The device would provide additional flow rate inside the production casing during a casing frac. It could also be used to stimulate new or existing intervals in the production casing (3). This is the base device used in FIG. 3. FIG. 2B has a packer (26) on the lower end of the stimulation tool (2B). The packer on the lower will direct all flow inside the production casing (3) above the packer (26). The stimulation tool (2B) would be used in a waterless fracturing application that started at the toe end of the production casing, in conjunction with an on/off sleeve or a propellant stimulation tool, and work additional intervals toward the heel end of the production casing.

Figure 2C:
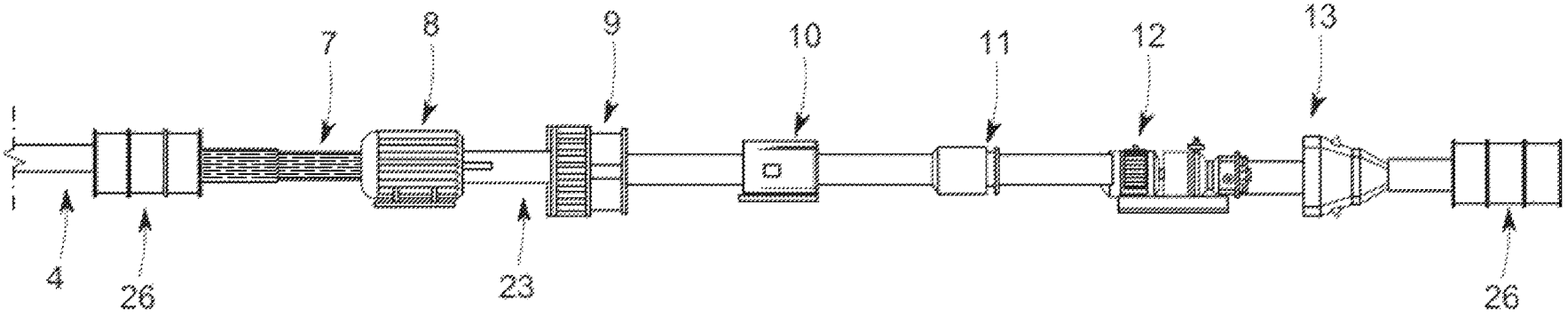

FIG. 2C has two packers (26) that isolate the section between the stimulation tool (2C). This stimulation tool (2C) would be used for re-fracturing an open interval in the production casing (3). The packers (26) isolate the area between them and assure the flow is directed into the desired interval in the production casing. It operates the same as the explanation in FIG. 3. All three examples use a reservoir of liquid propellant (7), a metering device (11), and a least one electric trigger (12). This is the basic components required to provide a propellant reaction that can be controlled in a beneficial manner. The pressure in the reservoir must be higher than the pressure in the production casing to force the liquid propellant through the metering device (11) and past the electric trigger (12). Additions such as the control module (8) and peripherals on control module extension (23) provide greater control and flexibility thus maximizing the value of the invention.

Figure 3:
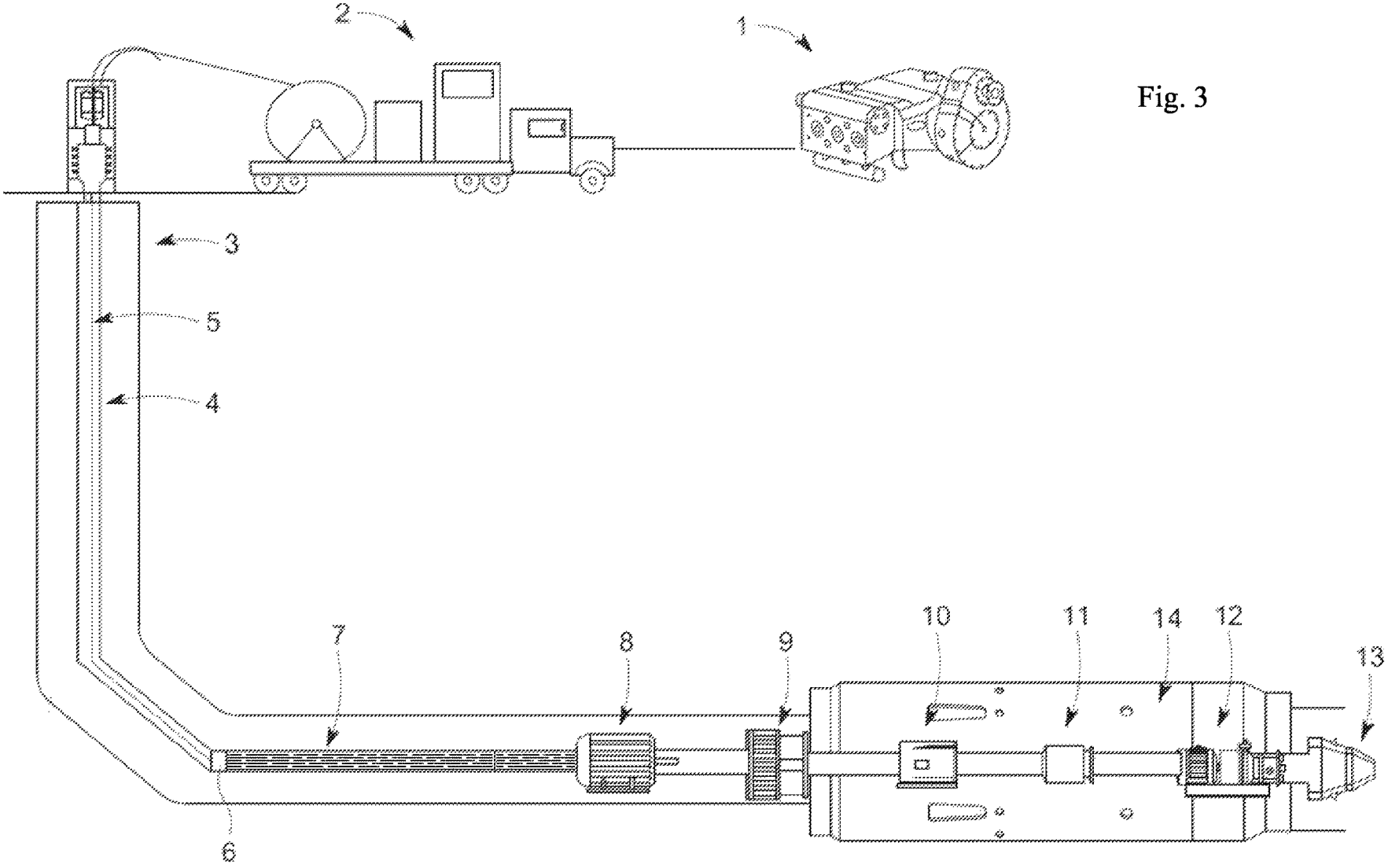
FIG. 3 depicts an expanded view of a stimulation tool configuration from FIG. 2A inside an expanded view of a sleeve with locating marker with profile.

FIG. 3 is a view of the process associated with use of a base stimulation tool inside a production casing (3). An external pump (1) provides positive pressure inside the coiled tubing that will force the liquid propellant in the annular area between the coiled tubing and the inside diameter of the production casing (3) when the metering device (11) is open. The external pump (1) will have a motor and fluid source and can be controlled manually or electronically using a surface control unit. The coiled tubing unit (2) is a mobile unit that carries enough coiled tubing to get to the deepest depth in the production casing (3) along with all the items required to attach to the wellhead. It is responsible for moving the coiled tubing (4) in and out of the production casing (3) to position the stimulation tool (2A) in the correct location. The coiled tubing (4) will contain a coaxial single or multi-conductor wire (5) on the inside of the coiled tubing that will provided power and communication from the surface control unit, that is part of the coiled tubing unit (2), to the control module (8) that is part of the stimulation tool (2A).

The coiled tubing (4) will contain a predetermined amount of propellant (7) inside the coiled tubing (4). The propellant (7) will start at the control module (8) and extend up the coiled tubing (4) to a wiper ring (6). The wiper ring (6) is a seal that provides isolation from the fluid used to pressure the inside diameter of the coiled tubing (4) and the liquid propellant (7). Once the stimulation tool (2A) is attached to the coiled tubing (4) the components power is applied to the coaxial cable (5). The control module will perform a series of programmed checks and verify the stimulation tool (2A) is ready to deploy. Once the control module (8) receives conformation the system passed the tests the stimulation tool (2A) is ready to be moved to the first stimulation position in production casing (3). The control module (8) is programmed to locate a specific position in the production casing (3). Once identified the control module will send power to the position locating and anchor device (9) that will expand keys that locate and anchor in the locating marker with profile (14).

Once anchored, the stimulation tool is ready to stimulate. The internal pressure is increased inside the coiled tubing (4) with the external pump (1), the meter valve (11) is opened to the desired flow area, and the electric trigger (12) is activated with the designated power to ignite the liquid propellant (7). The gas flows out of the nozzle (13) and into the interval to be stimulated through the locating marker with profile (14). The control module (8) regulates the volume of liquid propellant and the power to the electric trigger (12). There are two ways to regulate gas production. One is with the volume of liquid propellant released to flow across the electric trigger. The second is the power to electrodes inside the electric trigger (12). The more electrodes that are energized, the more propellant is activated prior to exiting the nozzle (13). It is possible for some of the liquid propellant not to ignite until after it is past the nozzle (13). Control of the meter valve (11) and electric trigger (12) may be done from surface control unit or logic programmed in the control module (8). The movement of liquid propellant (7) is based on higher pressure inside the coiled tubing (4) than inside production casing (3). It is important the propellant does not flow back into the coiled tubing (4) during stimulation. This could ignite propellant in the reservoir of liquid propellant (7).

A backflow prevention valve (10) is positioned between the position locating and anchor device (9) and the metering device (11). If the control module (8) detects backflow it will close the meter valve (11) and turn off the electric trigger (12) until a positive differential pressure is recognized inside the coiled tubing (4). The control module (8) uses information from peripherals such as pressure gauges and temperature gauges (24,25), and a flow meter (22) to analyze operation. It may be common for the electric trigger (12) and metering valve (11) to move between on and off position many times during stimulation. Once stimulation is complete the control module (8) closes the meter valve (11), turns power off to the electric trigger (12), and signals the position locating and anchor device (9) to release the keys. The program loads the next location into the control module (8) and begins reading to find the next interval. The nozzle (13) is a ported device that may contain up to three rows of ports. One row will angle up, one row will be 90 degrees to the ID, and one row will be angle down. The flow area will be set such that the upper row will discharge more gas and result in some tension on the stimulation device near the maximum designed flow rates.

The back flow (10) valve may be of several designs. A ball and seat would provide secure shut off while a tesla valve would provide resistance to back flow. The device may contain more than one backflow valve and any combination of valves. The metering device (11) will have a fully open, variable orifice, and fully closed position that is electrically controlled. The fail-safe position is closed. It may be a needle and seat controlled by a stepper motor or a variable meter like Fluid Metering Inc.'s valve less technology.

The control module (8) will contain a custom electronics board (20) with a processor connected to desired peripherals connected to the control module extension (23). The electronics card (20) will contain firmware capable of making decisions that adjust the peripherals function during operation. Electronics card (20) will contain a memory module to log events during stimulation of an interval. The location and anchoring device (9) will have a device such as coils capable of reading markers permanently located in the production casing (3) or some other locating method such as a collar locator, with communication to the control module (8). It will contain an anchoring method such as keys or slips with teeth that grip the production casing (3) that may be activated with an electric motor or electromagnetic force.

Figure 4:
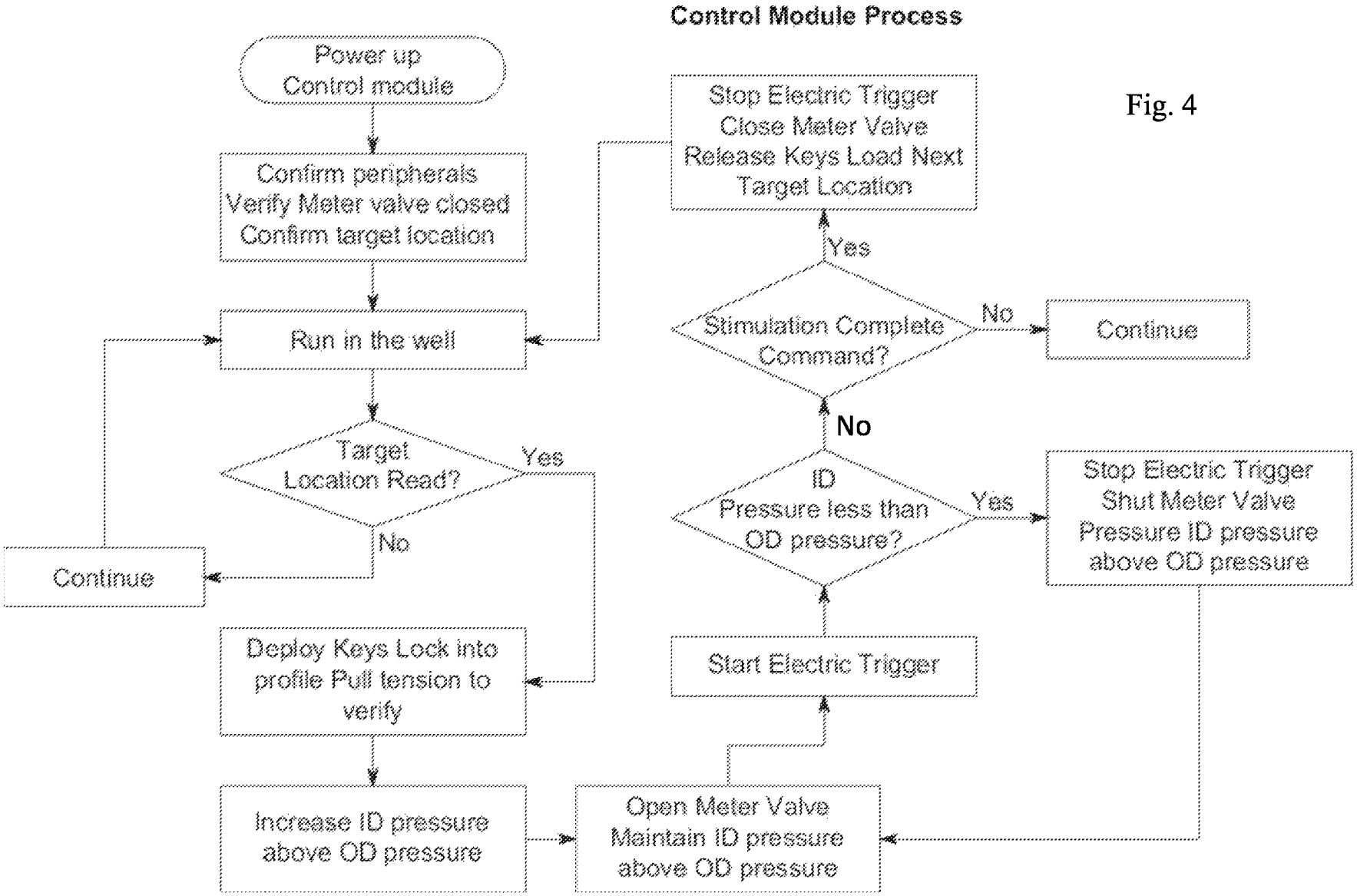
FIG. 4 depicts a logic diagram for the control module

FIG. 4 contains a basic logic sequence for the control module (8) and surface control unit. This logic is built into the firmware on the electronics card (20) contained in the control module (8). A surface control device such as a laptop PC or PLC controller would connect and communicate with electronics card (20).

Figure 5:
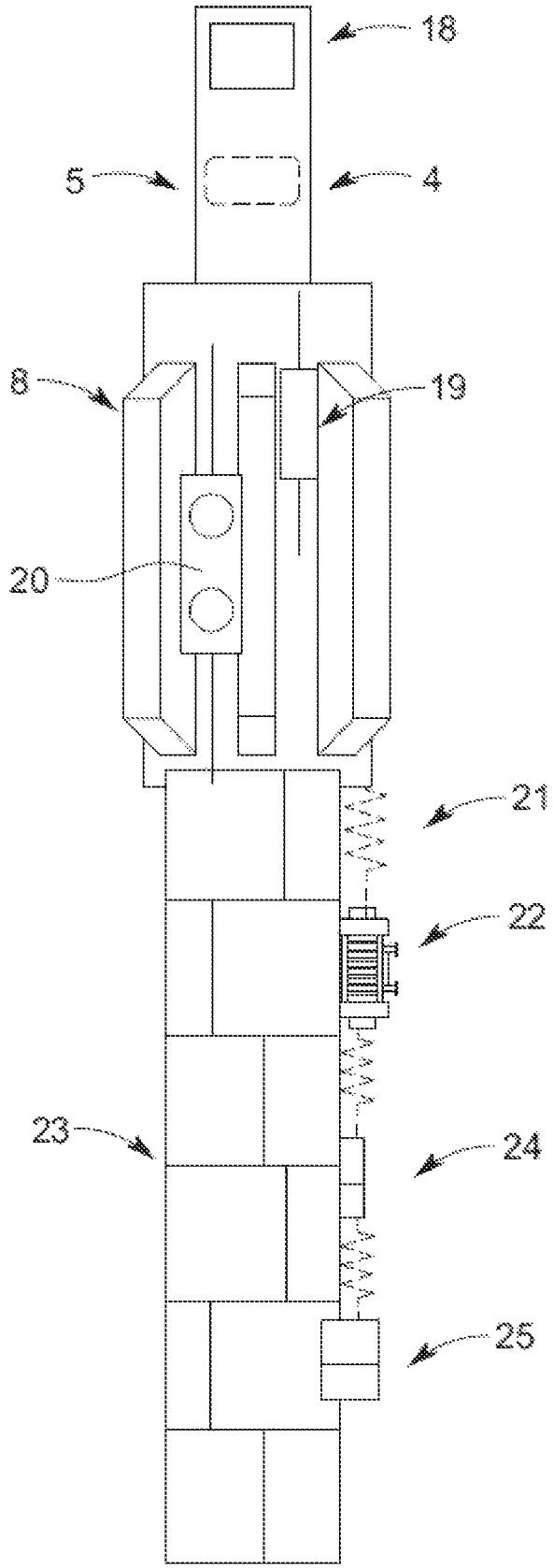
FIG. 5 depicts a detailed diagram for the control module

FIG. 5 is a detailed view of the control module (8) with the some of the optional peripherals on control module extension (23). The firmware on the electronics card (20) in control module (8) can make decisions based on information from the peripherals and change the settings on the metering device (11) and/or the electric trigger (12) with or without assistance from surface depending on configuration. The tension and compression load with accelerometer (18) provide information regarding the loading on the coiled tubing (4) at the control module (8). It provides a clear indication that the position locating and anchor device (9) is properly anchored. Information on the loading and movement during the stimulation as well as proper release of the locating and anchoring device (9) are recorded and sent to surface in real time.

The coaxial line (5) from surface terminates at the control module (8). This is the path for raw power and two-way communication. The power and communication regulator (19) conditions the power and sends the proper voltage to the electronics card (20). It also receives information from the electronics card (20) and sends it back to surface. The electronics card (20) contains all the electronic components required to send and receive communication to surface, store information from peripherals, motor or other controls to function peripherals, and firmware and software to process information received from surface and the peripherals. The power and communication wire (21) provide a link for power and communication from the electronics card (20).

The Flowmeter (22) is capable of reading flow rate inside control module peripheral extension (23) in either direction. It can also determine the direction of flow. The control module peripheral extension (23) provides the necessary accommodations for the peripherals. This part may vary with different peripheral configurations. The ID pressure and temperature recorder (24) provides information for the inside of the coiled tubing (4). It is particularly important the pressure inside the coiled tubing (4) is higher than the outside pressure. This prevents backflow and accidental ignition of the propellant in the reservoir. The Outside Diameter pressure and temperature recorder (25) records pressure and temperature between the outside of the control module (8) and the inside of the production casing (3). The lower end of control module peripheral extension (23) connects to the position locating and anchor device (9).

| Drawing Reference | Description |
|---|---|
| 1 | External High pressure pump |
| 2 | Coiled Tubing unit |
| 3 | Production casing |
| 4 | Coiled Tubing |
| 5 | Coaxial electric line |
| 6 | Wiper spacer ring |
| 7 | Liquid propellant. |
| 8 | Control module |
| 9 | Position locating and anchor device |
| 10 | Backflow prevention valve |
| 11 | Metering device |
| 12 | Electronic trigger device |
| 13 | Nozzle |
| 14 | Locating marker with profile. |
| 2A | Base Stimulation Tool |
| 2B | Waterless Fracturing Stimulation Tool |
| 2C | Re-fracturing Stimulation Tool |
| 18 | Tension and compression load and accelerometer |
| 19 | Power and communication regulator |
| 20 | Electronics Card |
| 21 | Power and communication wire |
| 22 | Flow meter |
| 23 | Control module extension |
| 24 | ID pressure and temperature recorder |
| 25 | OD pressure and temperature recorder |
| 26 | Packer |
| 27 | Production Packer |
| 28 | Float Shoe |

What is claimed:

1. An apparatus for selectively stimulating an interval in a production casing by controlling the rate of gas produced by an ignited propellant comprising:

coiled tubing with a coaxial power and communication cable therein;

a meter valve for regulating the flow in the tubing of a liquid propellant at least one electronic trigger for igniting the liquid propellant;

a control module for controlling the meter valve and the electronic trigger;

a position locating and anchor device for locating a known position within the production casing and anchoring at the position;

at least one backflow valve for controlling the direction of flow of the liquid propellant and a nozzle for dispersing at least one or more of the liquid propellant or a gas generated by the ignition of the liquid propellant.

2. The apparatus of claim 1 wherein the liquid propellant is an electrically triggerable liquid propellant.

3. The apparatus of claim 1 wherein the production casing comprises a known marker.

4. The apparatus of claim 3 wherein the position locating and anchor device comprises expanding keys for anchoring into the production casing.

5. The apparatus of claim 1 wherein the nozzle is designed to pull tension on the tubing when at least one or more of the liquid propellant, or a gas generated by the ignition of the liquid propellant, exits the nozzle.

6. The apparatus of claim 1 wherein the control module regulates the flow of the liquid propellant.

7. The apparatus of claim 1 where the control module regulates power to the electronic trigger to throttle the gas created by ignition of the liquid propellant.

8. The apparatus of claim 1 wherein the electronic trigger ignites the liquid propellant that is inside the coiled tubing.

9. The apparatus of claim 1 wherein the electronic trigger ignites the liquid propellant that is outside of the coiled tubing.

10. The apparatus of claim 1 wherein the electronic trigger is positioned on the outside of the production casing.

11. The apparatus of claim 1 further comprising at least one electrically controlled packer located on the coiled tubing above the control module and at least one electrically controlled packer below the nozzle.

* * * * *